US011000135B2

(12) United States Patent
Tan

(10) Patent No.: US 11,000,135 B2
(45) Date of Patent: May 11, 2021

(54) UNDERCOUNTER DISPENSER

(71) Applicant: Stephanie Tan, Harahan, LA (US)

(72) Inventor: Stephanie Tan, Harahan, LA (US)

( * ) Notice: Subject to any disclaimer, the term of this patent is extended or adjusted under 35 U.S.C. 154(b) by 0 days.

(21) Appl. No.: 14/588,265

(22) Filed: Dec. 31, 2014

(65) Prior Publication Data

US 2015/0108156 A1 Apr. 23, 2015

Related U.S. Application Data

(63) Continuation of application No. PCT/US2013/056608, filed on Aug. 29, 2013.

(51) Int. Cl.
*A47F 9/04* (2006.01)
*A47F 1/12* (2006.01)
*A47F 13/08* (2006.01)

(52) U.S. Cl.
CPC ..... *A47F 9/042* (2013.01); *A47F 13/085* (2013.01)

(58) Field of Classification Search
CPC ..... A47F 1/121; A47F 9/042; A47F 13/085
See application file for complete search history.

(56) References Cited

U.S. PATENT DOCUMENTS 3,341,003 A * 9/1967 Marsh ..... B65D 83/08 206/499
3,777,439 A * 12/1973 Fried ..... B65D 83/08 53/492
3,918,589 A * 11/1975 Nausedas ..... B65D 33/001 211/57.1
4,113,109 A * 9/1978 Donnelli et al. ..... 211/49.1
5,060,809 A 10/1991 Bayes
5,205,435 A * 4/1993 Daniels ..... A47F 13/085 206/554
5,209,371 A * 5/1993 Daniels ..... A47F 13/085 221/63
5,269,416 A 12/1993 DeMatteis
5,301,832 A 4/1994 Daniels
RE34,856 E * 2/1995 Daniels ..... A47F 13/085 221/63
5,405,021 A * 4/1995 Smithson ..... 211/50
5,480,084 A * 1/1996 Daniels ..... B26F 3/002 225/106

(Continued)

*Primary Examiner* — Gene O Crawford
*Assistant Examiner* — Kelvin L Randall, Jr.
(74) *Attorney, Agent, or Firm* — David A. Belasco; Belasco Jacobs & Townsley, LLP

(57) ABSTRACT

An undercounter dispenser includes a fixed receiving station and a separate bag tray. The receiving station has a support platform and at least two suspension elements attached to the platform. Each of the elements has at least one attachment fixture. At least one retaining ledge is provided. The ledge is attached to a proximal end of the platform. The bag tray is adapted to slide over the retaining ledge and descend behind the ledge upon insertion into the receiving station. The retaining ledge limits forward and aft movement of the tray within the receiving station. The bag tray has at least one mounting spike that extends upwardly from the tray. First and second side panels are attached to the platform and extend upwardly from the platform. A rear panel is attached to a distal end of the support platform and limits movement of the bag tray within the receiving station.

13 Claims, 7 Drawing Sheets

(56) References Cited

U.S. PATENT DOCUMENTS

RE35,207 E * 4/1996 Daniels ..... A47F 13/085 206/554
5,524,763 A 6/1996 Wile
5,584,402 A * 12/1996 Johnson ..... 211/50
5,816,076 A * 10/1998 Biedermann ..... E05B 73/0082 70/57
5,871,115 A 2/1999 Kohn
5,924,573 A * 7/1999 Piraneo ..... B65D 33/001 206/554
6,068,228 A * 5/2000 Kobayashi ..... F25C 5/00 248/309.1
6,098,806 A 8/2000 Mills
6,520,349 B2 2/2003 Keen
6,543,638 B2 * 4/2003 Wile ..... A47F 5/01 206/554
6,578,729 B2 * 6/2003 Grinberg ..... A41D 19/0072 2/159
7,481,327 B2 * 1/2009 Cheng ..... 220/4.33
8,067,072 B2 * 11/2011 Tan ..... 428/35.7
8,196,873 B2 6/2012 Kohn
8,381,921 B2 * 2/2013 Tan ..... A47F 9/042 211/85.15
8,397,923 B2 * 3/2013 Tan ..... F16M 13/027 211/85.15
8,567,618 B2 * 10/2013 Tan ..... 211/85.15
8,590,714 B1 * 11/2013 Osuna-Valerio ..... E05G 1/005 211/4
9,265,364 B2 * 2/2016 Tan ..... A47F 9/042
2006/0049199 A1 * 3/2006 West ..... A61B 42/40 221/26
2012/0111810 A1 * 5/2012 Tan ..... 211/59.2
2012/0111811 A1 * 5/2012 Tan ..... 211/59.2
2012/0118839 A1 * 5/2012 Tan ..... 211/59.2
2013/0284756 A1 * 10/2013 Springer et al. ..... 221/34
2014/0318085 A1 * 10/2014 Sill ..... B65B 5/045 53/473
2015/0083677 A1 * 3/2015 Tan ..... 211/59.1
2018/0148210 A1 * 5/2018 Bacallao ..... A47F 9/043

* cited by examiner

UNDERCOUNTER DISPENSER

RELATED APPLICATION

The instant application is a continuation of Application Serial No. PCT/US2013/056608, filed Aug. 29, 2013 and currently pending, the disclosure of which is hereby incorporated by reference in its entirety.

FIELD OF INVENTION

The invention pertains to dispensers for plastic and other film bags typically used for produce or other merchandise. More particularly, the invention relates to dispensers designed to be suspended beneath store counters employing a removable bag support tray.

BACKGROUND OF THE INVENTION

Plastic and other film produce bags are commonly used in supermarkets, grocery stores and other markets where sanitation and ease of use in limited spaces are important factors. It is efficient to have a ready supply of grocery bags close at hand for use by the checkout operator, however it is also useful if the checkout counter top can remain unobstructed to accommodate the flow of groceries and other goods past the checkout station. For these reasons, a compact, easy to use and easy to refill undercounter bag dispenser can save valuable counter space and improved work flow for the checkout operator.

U.S. Pat. No. 5,584,402, issued to Johnson is directed to a bag storage and dispensing rack and includes a base member with a rack structure that engages the track of the base member and is adapted for supporting a supply of bags. The base member is suspended from a horizontal surface utilizing brackets. The rack is utilized for storing and dispensing a supply of bags and includes the rack with base member wherein the rack includes a tray or rack that is adapted for supporting a supply of bags and is configured such that rack slides into base member from a bag loading position to a bag dispensing position. The supply of bags is mounted to a rack utilizing a post which projects upwardly from surface of rack in order to receive the bags. The bags are of a T-shirt or header style and are supported on rack by the post through an aperture contained within the mouth area of bags. The rack is used for storing and dispensing multiple size T-shirt or header style bags wherein the smaller size bags are disposed on the post on top of the supply of larger bags.

U.S. Pat. No. 6,543,638, issued to Wile, discloses a method and means of dispensing T-shirt type bags from a rack mounted beneath a counter from a tray which slides horizontally into a standard rack. The primary object of the invention is to provide a bag, tray, and rack system which dispenses at least two sizes of T-shirt type plastic bags from a convenient position beneath a counter. The tray has spikes which are used to receive a bundle of plastic bags which have mating holes through the entire pad of bags. The tray slides into the rack described above which receives it and locks into position such that the bags may be pulled out one at a time by tearing each bag away from the spikes while the other bags remain behind. The tray and rack system is formed from quarter-inch steel wire or equivalent and is welded at its junction points. The wire rack is designed to be mountable underneath a checkout counter by means of a series of tabs.

U.S. Pat. No. 5,871,115, issued to Kohn, is directed to an article supporting and dispensing apparatus and specifically for supporting bags on hooks. The housing of the apparatus is adapted to receive racks which slide on holding member within the housing. Hooks are removably mounted to rods of racks and the bags are placed thereon before sliding the racks into housing. Mounting members are utilized to mount the racks which may be located on a wall, counter, or under a counter as well.

U.S. Pat. No. Re. 34,856, issued to Daniels is directed to a method and apparatus for dispensing merchandise bags and even though the bags are dispensed from a roll, the wire structure is shown to dispense T-shirt bags. The racks are designed with brackets (not numbered) that allow for installation beneath a counter. The racks are designed to accommodate a plurality of sizes.

U.S. Pat. 5,060,809 issued to Bayes et al. is directed to a device for holding bags and is designed such that differently sized bags may be mounted for dispensing at the same time. The rack may be mounted on the underside of a horizontal surface such as under a counter.

While other variations exist, the above-described designs for bag dispensers are typical of those encountered in the prior art. It is an objective of the present invention to provide an undercounter dispenser for stacked film bags to optimize use of checkout area counter space. It is a further objective to provide dispenser that uses bag support tray that can be preloaded with bag stacks for ready insertion into the dispenser. It is yet a further objective to provide bag support tray that can be easily adapted to different size bags and bags with differently spaced mounting apertures. It is a still further objective of the invention to provide a receiving station for the bag support trays that will prevent unwanted movement of the tray. Finally, it is an objective of the invention to provide a dispenser that is economical to produce, simple to use and easy to clean.

While some of the objectives of the present invention are disclosed in the prior art, none of the inventions found include all of the requirements identified.

SUMMARY OF THE INVENTION

The present invention addresses all of the deficiencies of prior art undercounter dispenser inventions and satisfies all of the objectives described above.

(1) An undercounter dispenser meeting all of the above objectives can be constructed from the following components. A fixed receiving station is provided. The station has a support platform and at least two suspension elements. The elements are attached to the platform. Each of the elements has at least one attachment fixture. At least one retaining ledge is provided. The ledge is attached to a proximal end of the platform. A separate bag tray is provided. The tray is sized and shaped to fit within the receiving station and has at least one mounting spike. The mounting spike extends upwardly from the tray. The bag tray is adapted to slide over the retaining ledge and descend behind the ledge upon insertion into the receiving station. The retaining ledge limits forward and aft movement of the tray within the receiving station.

(2) In a variant of the invention, the undercounter dispenser further includes first and second side panels. The side panels are attached to the support platform and extend upwardly from the platform.

(3) In another variant, the undercounter dispenser further includes a rear panel. The rear panel is attached to a distal end of the support platform and limits forward and aft movement of the tray within the receiving station.

(4) In still another variant, the at least two suspension elements are incorporated in the first and second side panels.

(5) In yet another variant, the undercounter dispenser further includes a top panel. The top panel connects the at least two suspension elements.

(6) In a further variant, the at least one mounting spike is mounted to at least two alternative positions on the bag tray.

(7) In still a further variant, the at least one mounting spike is mounted to a sub platform. The sub platform is mounted to at least two alternative positions on the bag tray.

(8) In yet a further variant, the bag tray includes a planar mounting plate. The plate includes at least one transverse slot. The slot is sized and shaped to provide adjustable mounting for the at least one mounting spike.

(9) In another variant of the invention, the attachment features are a series of mounting openings incorporated in upper portions of the side panels.

(10) In still another variant, the attachment features are a series of mounting openings incorporated in upper portions of proximal and distal ends of the receiving station.

(11) In yet another variant, the undercounter dispenser further includes a stack of film bags. The bags have a front wall and a back wall. The walls have first and second side edges and a bottom edge. The front and back walls are joined at the first and second side edges and the bottom edges. At least one of the front and back walls has at least one mounting aperture adjacent an upper end of the bag.

(12) In a further variant, the at least one mounting aperture is frangible.

(13) In still a further variant, the at least one mounting aperture is located in an upper portion of the bag. The upper portion is frangibly attached to the bag.

(14) In yet a further variant, the at least one mounting aperture is located in a header strip. The header strip is removably attached to the upper end of the bag.

(15) In a final variant of the invention, the stack of film bags is enclosed in a flexible pouch. The pouch has at least hole aligned with the at least one mounting aperture.

An appreciation of the other aims and objectives of the present invention and an understanding of it may be achieved by referring to the accompanying drawings and the detailed description of a preferred embodiment.

DETAILED DESCRIPTION OF THE PREFERRED EMBODIMENT

The present invention addresses all of the deficiencies of prior art undercounter dispenser inventions and satisfies all of the objectives described above.

Figure 1:
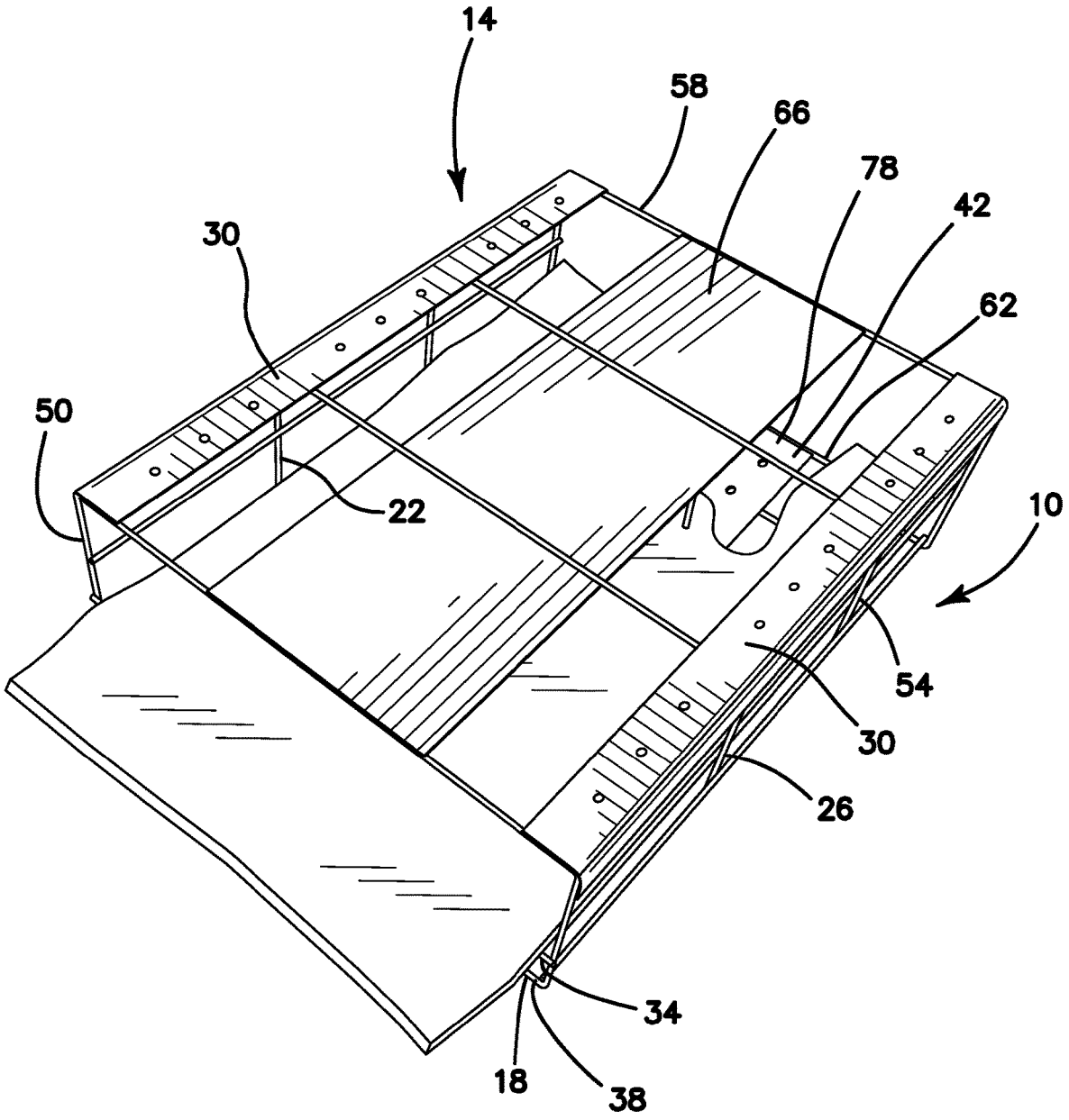
FIG. 1 is a perspective view of a preferred embodiment of the dispenser in combination with a stack of film bags.
Figure 2:
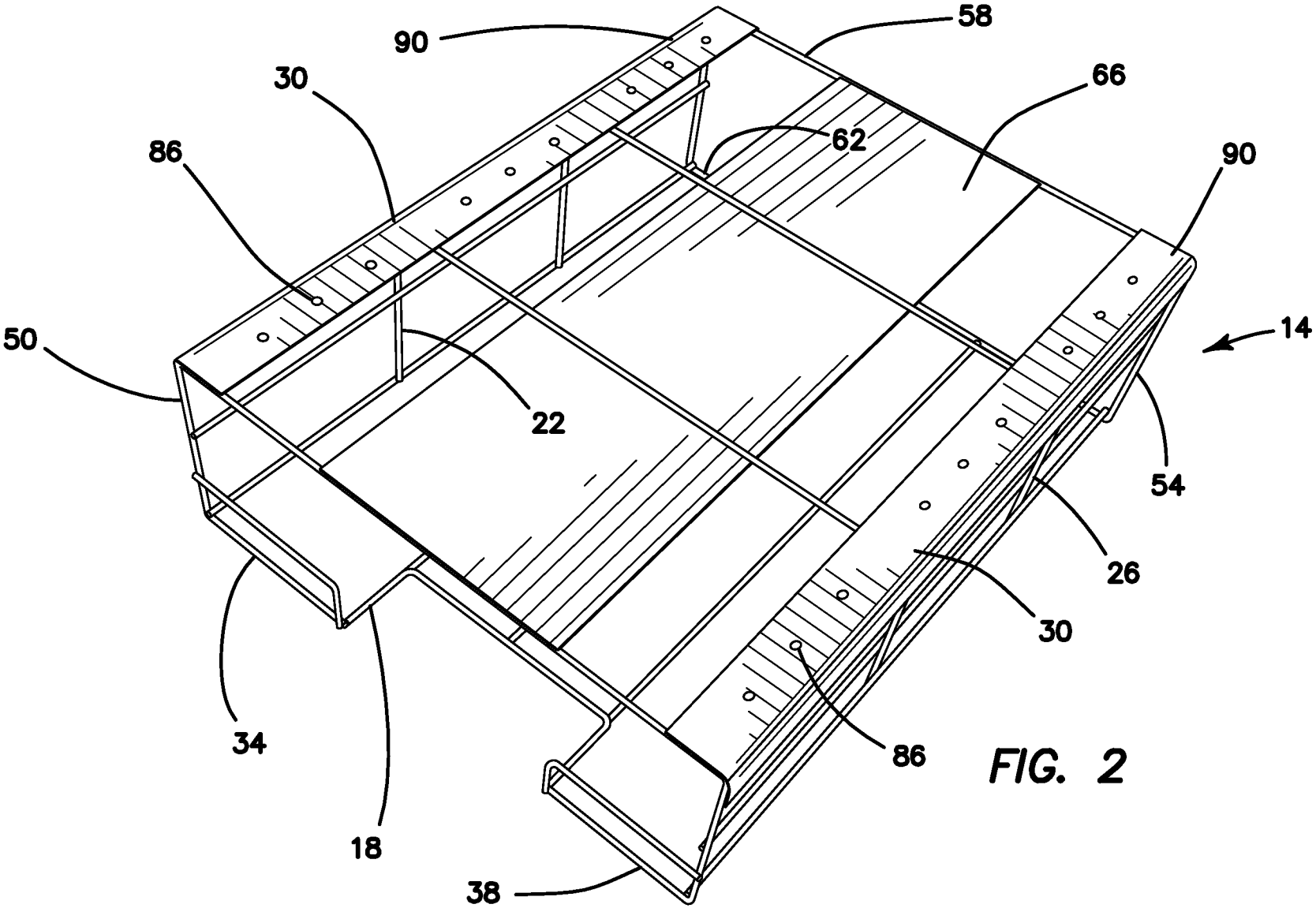
FIG. 2 is a perspective view of the receiving station of the FIG. 1 embodiment.
Figure 3:
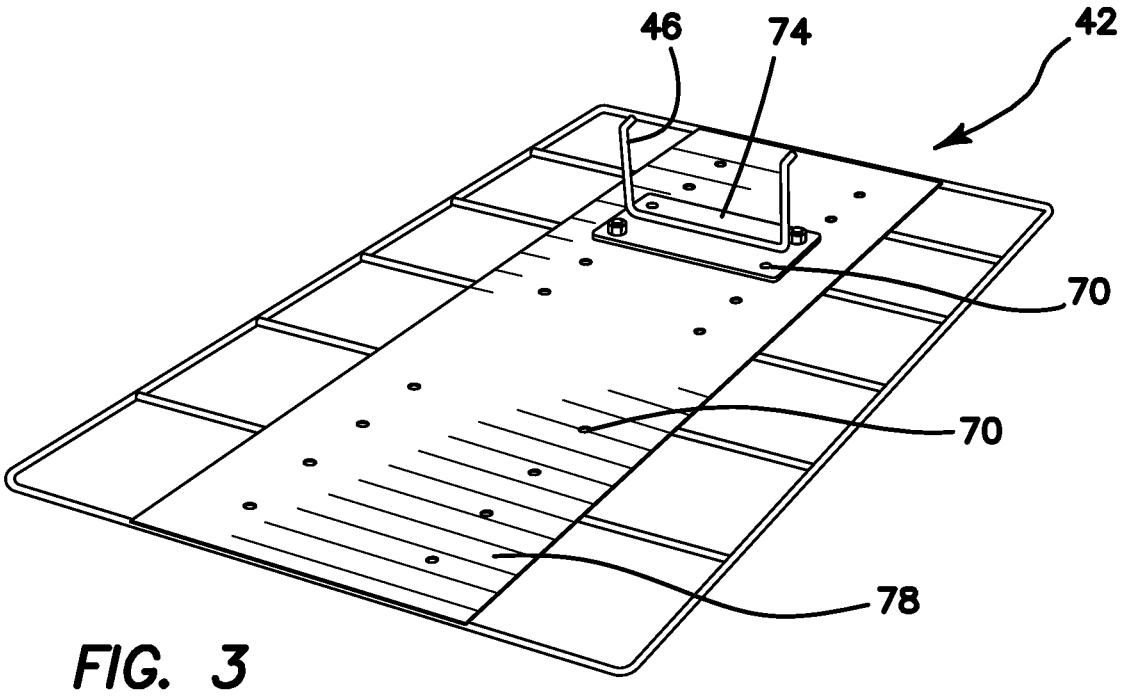
FIG. 3 is a perspective view of the bag tray of the FIG. 1 embodiment with sub platform and mounting spikes attached.
Figure 4:
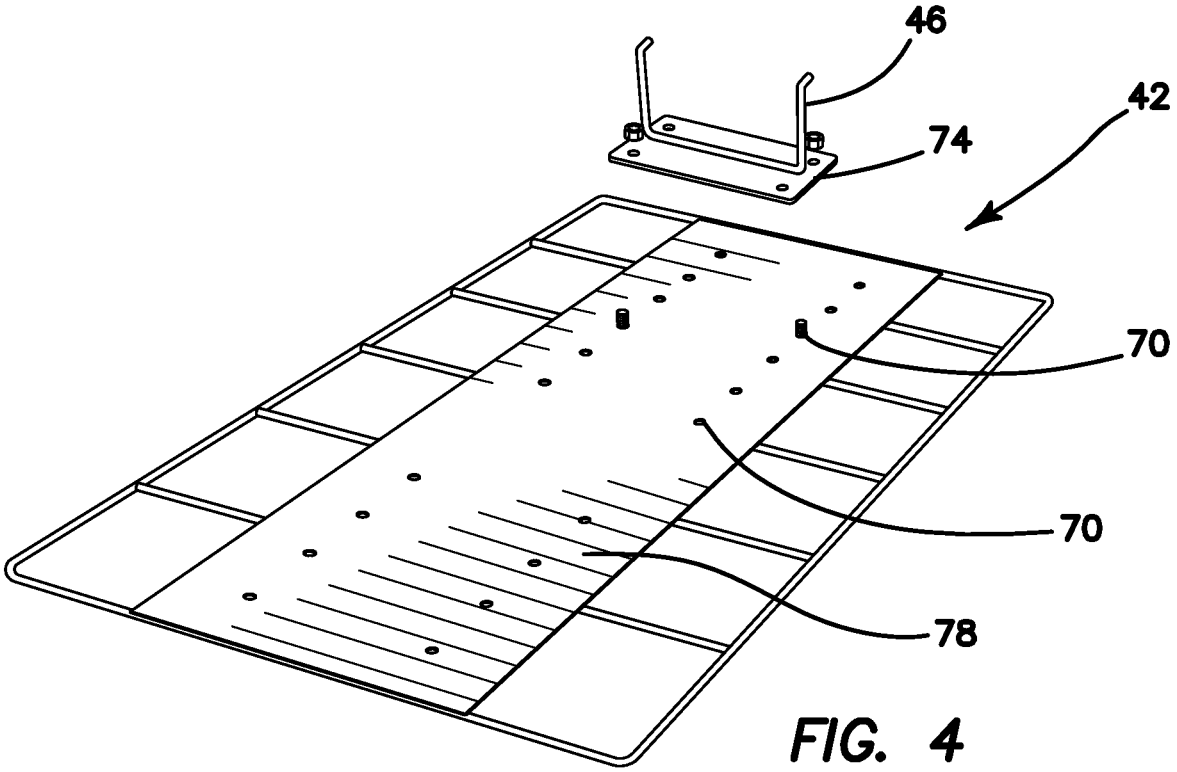
FIG. 4 is a perspective view of the bag tray of the FIG. 1 embodiment with sub platform and mounting spikes removed for remounting in an alternative position.
Figure 5:
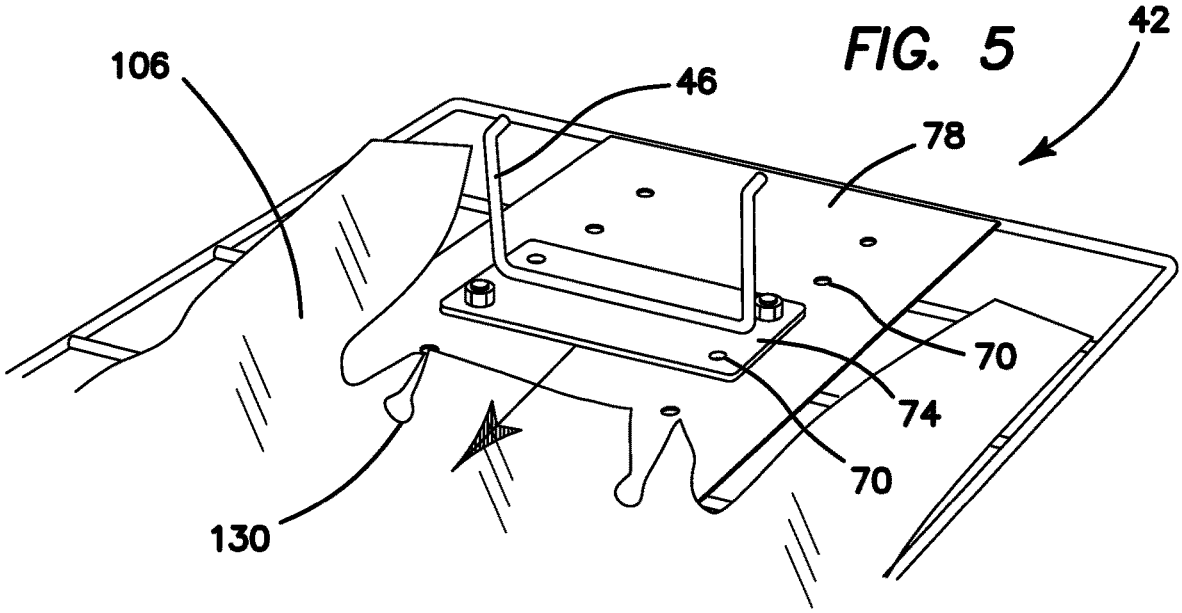
FIG. 5 perspective view of the bag tray of the FIG. 1 embodiment illustrating a film bag with frangible mounting apertures being removed from the tray.

(1) FIGS. 1-12 illustrate an undercounter dispenser 10 meeting all of the above objectives can be constructed from the following components. As illustrated in FIGS. 1 and 2, a fixed receiving station 14 is provided. The station 14 has a support platform 18 and at least two suspension elements 22, 26. The elements 22, 26 are attached to the platform 18. Each of the elements 22, 26 has at least one attachment fixture 30. At least one retaining ledge 34 is provided. The ledge 34 is attached to a proximal end 38 of the platform 18. As illustrated in FIGS. 3-5, a separate bag tray 42 is provided. The tray 42 is sized and shaped to fit within the receiving station 14 and has at least one mounting spike 46. The mounting spike 46 extends upwardly from the tray 42. The bag tray 42 is adapted to slide over the retaining ledge 34 and descend behind the ledge 34 upon insertion into the receiving station 14. The retaining ledge 34 limits forward and aft movement of the tray 42 within the receiving station 14.

(2) In a variant of the invention, as illustrated in FIGS. 1 and 2, the receiving station 14 further includes first 50 and second 54 side panels. The side panels 50, 54 are attached to the support platform 18 and extend upwardly from the platform 18.

(3) In another variant, the receiving station 14 further includes a rear panel 58. The rear panel 58 is attached to a distal end 62 of the support platform 18 and limits forward and aft movement of the tray 42 within the receiving station 14.

(4) In still another variant, the at least two suspension elements 22, 26 are incorporated in the first 50 and second 54 side panels.

(5) In yet another variant, the undercounter dispenser 10 further includes a top panel 66. The top panel 66 connects the at least two suspension elements 22, 26.

(6) In a further variant, as illustrated in FIGS. 3-5, the at least one mounting spike 46 is mounted to at least two alternative positions 70 on the bag tray 42.

(7) In still a further variant, the at least one mounting spike 46 is mounted to a sub platform 74. The sub platform 74 is mounted to at least two alternative positions 70 on the bag tray 42.

Figure 6:
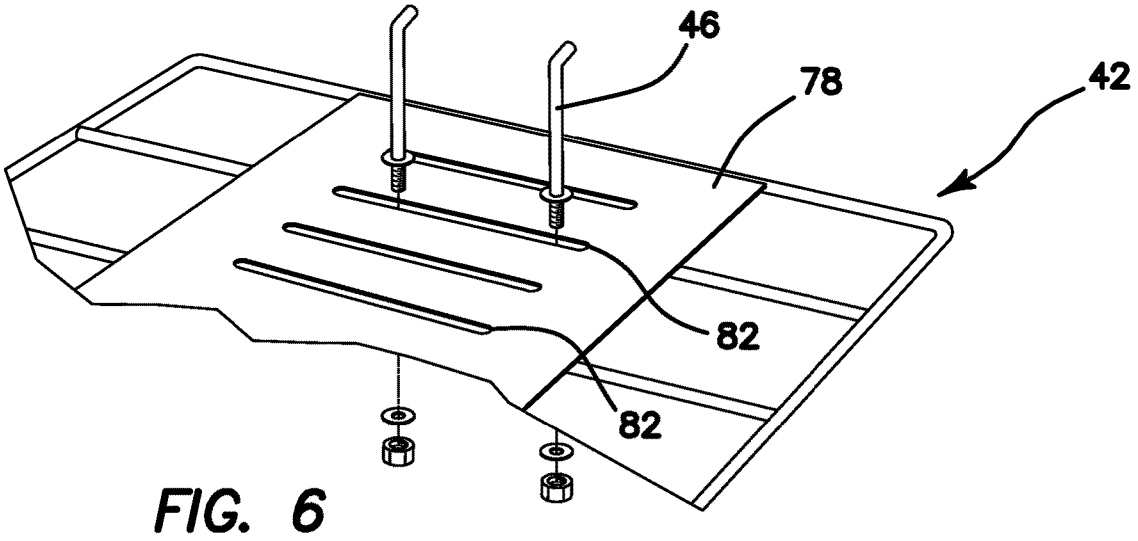
FIG. 6 is a partial perspective view of an alternative bag tray illustrating elongated slots for the mounting spikes.
Figure 8:
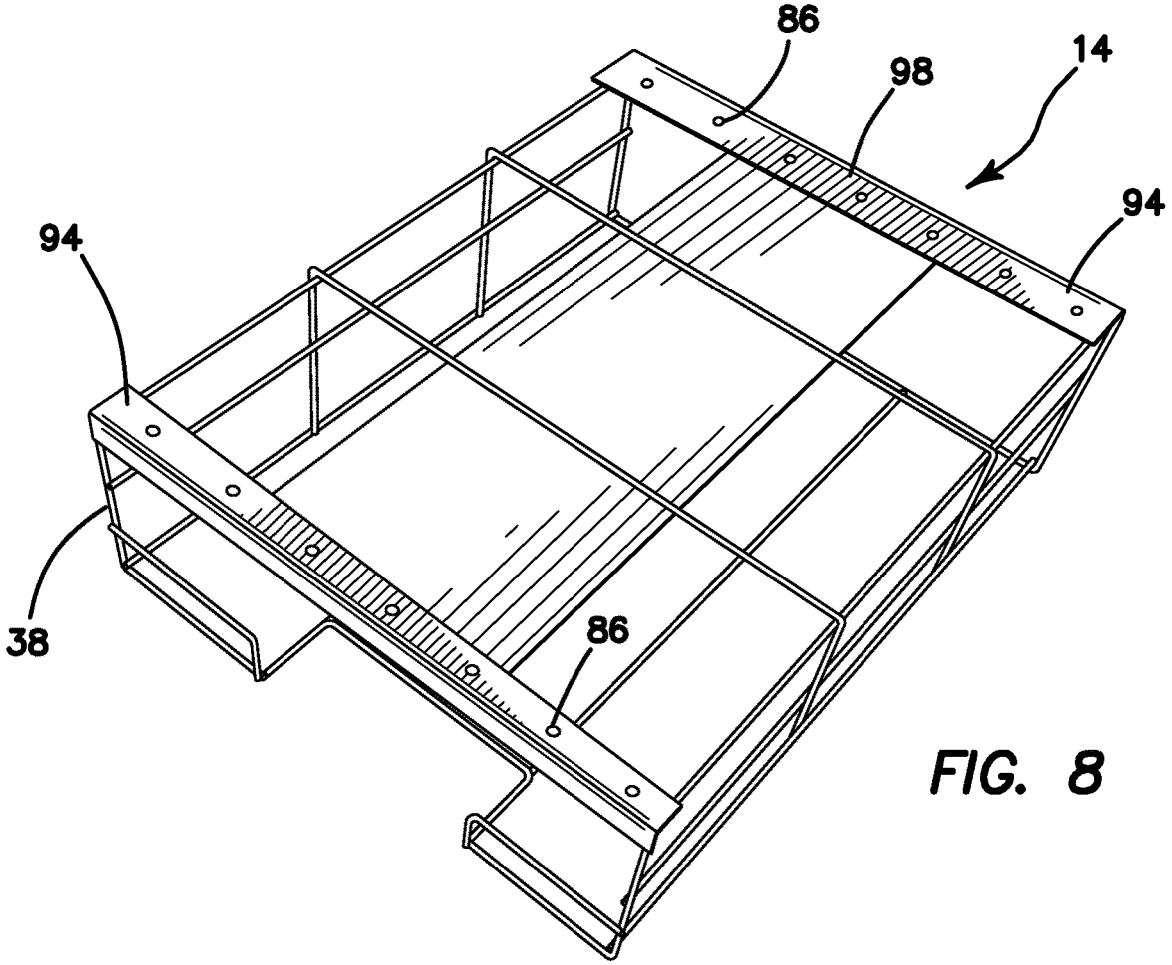
FIG. 8 is a perspective view of an alternative receiving station having mounting openings at the proximal and distal ends of the receiving station.

(8) In yet a further variant, as illustrated in FIG. 6, the bag tray 42 includes a planar mounting plate 78. The plate 78 includes at least one transverse slot 82. The slot 82 is sized and shaped to provide adjustable mounting for the at least one mounting spike 46.

Figure 7:
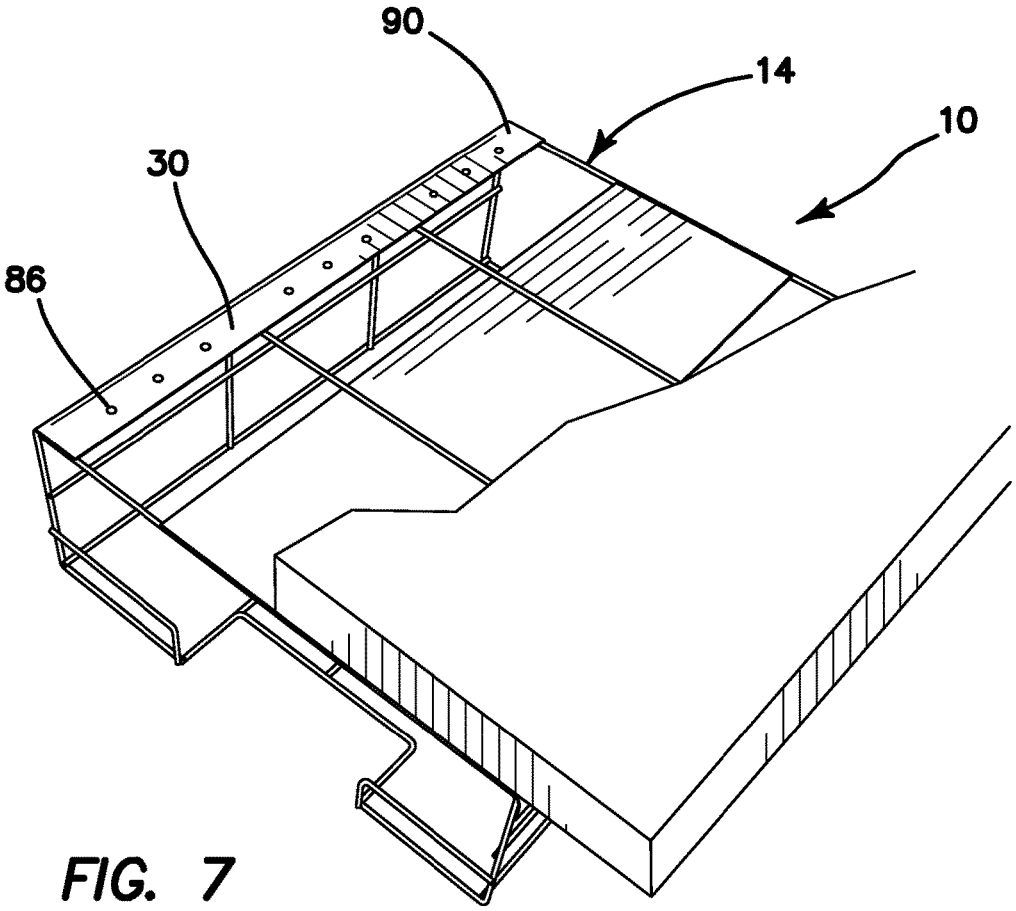
FIG. 7 is a break-away perspective view of the FIG. 1 embodiment receiving station mounted under a counter.

(9) In another variant of the invention, as illustrated in FIGS. 1, 2 and 7, the attachment features 30 are a series of mounting openings 86 incorporated in upper portions 90 of the side panels 50, 54.

(10) In still another variant, the attachment features 30 are a series of mounting openings 86 incorporated in upper portions 94 of proximal 38 and distal 98 ends of the receiving station 14.

Figure 9:
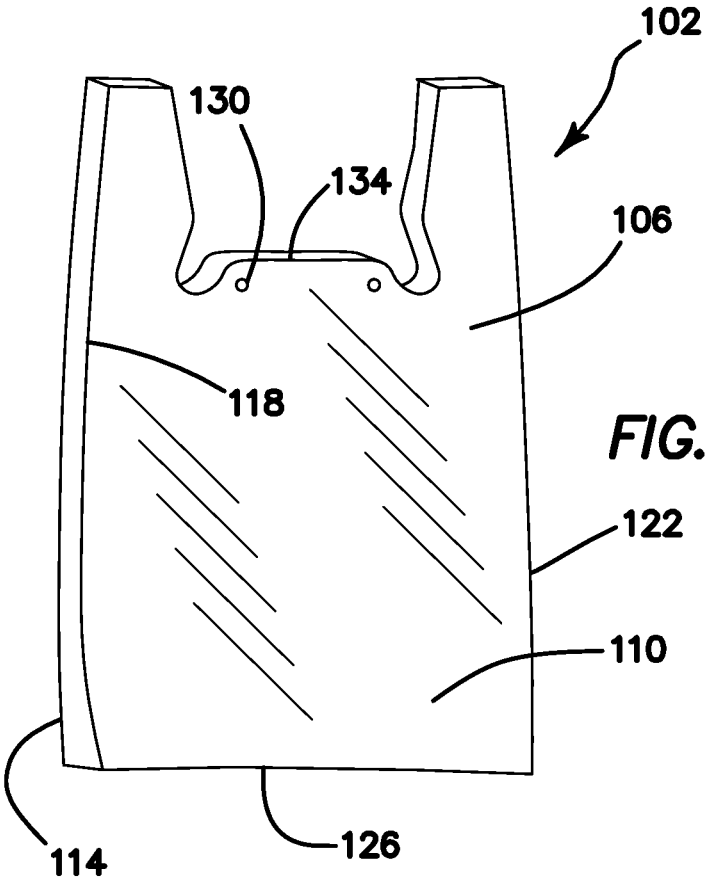
FIG. 9 is a perspective view of a t-shirt style bag for use with the dispenser having frangible mounting apertures in the front and rear walls.

(11) In yet another variant, as illustrated in FIG. 9, the undercounter dispenser 10 further includes a stack 102 of film bags 106. The bags 106 have a front wall 110 and a back wall 114. The walls 110, 114 have first 118 and second 122 side edges and a bottom edge 126. The front 110 and back 114 walls are joined at the first 118 and second 122 side edges and the bottom edges 126. At least one of the front 110 and back 114 walls has at least one mounting aperture 130 adjacent an upper end 134 of the bag 106.

(12) In a further variant, the at least one mounting aperture 130 is frangible.

Figure 10:
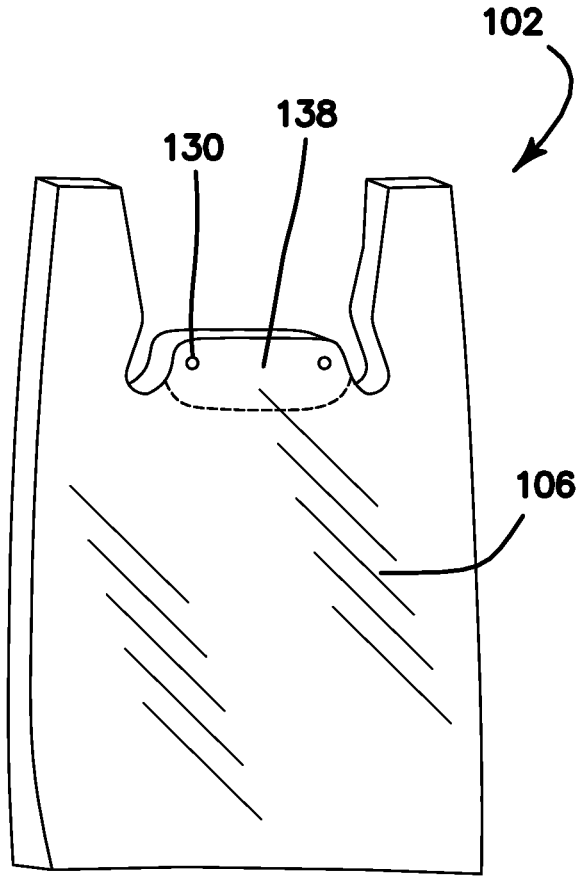
FIG. 10 is a perspective view of a t-shirt style bag for use with the dispenser having a frangibly attached upper portion comprising the mounting apertures.

(13) In still a further variant, as illustrated in FIG. 10, the at least one mounting aperture 130 is located in an upper portion 138 of the bag 106. The upper portion 138 is frangibly attached to the bag 106.

Figure 11:
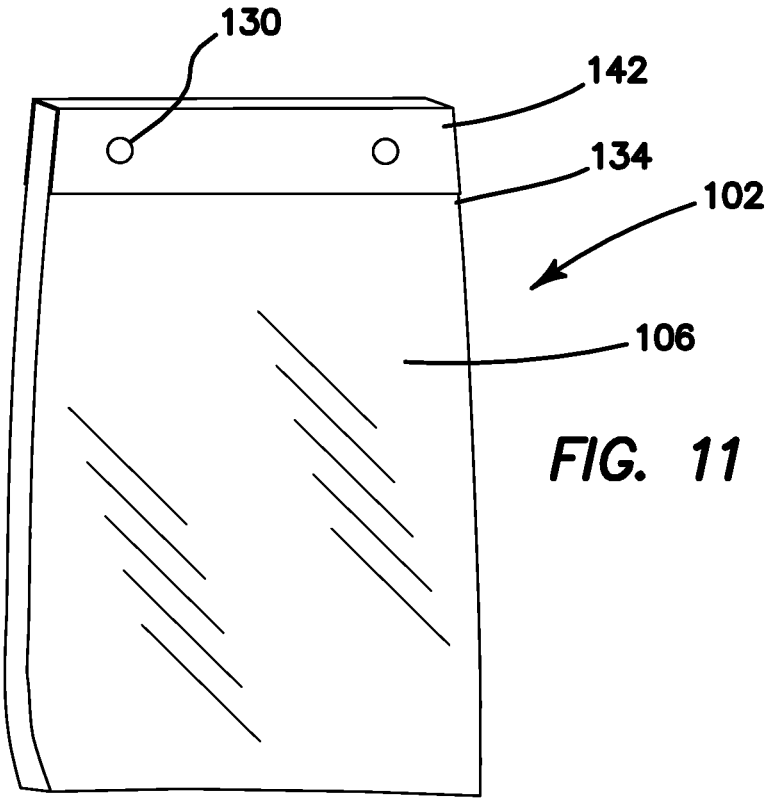
FIG. 11 is a perspective view of a stack of header bags for use with the dispenser.

(14) In yet a further variant, as illustrated in FIG. 11, the at least one mounting aperture 130 is located in a header strip 142. The header strip 142 is removably attached to the upper end 134 of the bag 106.

Figure 12:
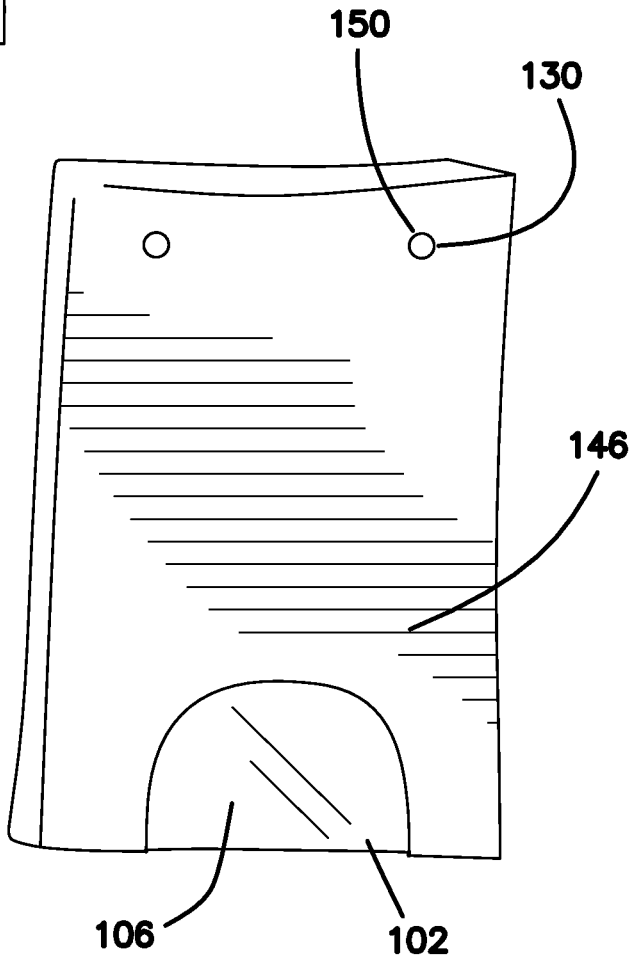
FIG. 12 is a perspective view of a stack of film bags inside of a flexible pouch.

(15) In a final variant of the invention, as illustrated in FIG. 12, the stack 102 of film bags 106 is enclosed in a flexible pouch 146. The pouch 146 has at least hole 150 aligned with the at least one mounting aperture 130.

An appreciation of the other aims and objectives of the present invention and an understanding of it may be achieved by referring to the accompanying drawings and the detailed description of a preferred embodiment.

The invention claimed is:

1. An undercounter dispenser comprising:

a fixed receiving station, said fixed receiving station having a horizontal bottom support platform formed of at least two rails, at least two suspension elements, said at least two suspension elements being attached to an upper surface of said horizontal bottom support platform, each of said at least two suspension elements having at least one stationary non-movable plate-like attachment fixture, said stationary non-movable plate-like attachment fixture being attached to a top portion and a side portion of said receiving station and having a top section and a side section descending from said top section, said at least two suspension elements being attached to said side section, said at least one stationary non-movable plate-like attachment fixture adapted to suspend said fixed receiving station from an underside of a substantially horizontal surface with said horizontal bottom support platform disposed directly below said at least one stationary non-movable plate-like attachment fixture, at least two retaining ledges, said at least two retaining ledges being attached to a proximal end of said horizontal bottom support platform;

a separate bag tray, said bag tray having a planar upper surface, being sized and shaped to fit within said receiving station and having at least one mounting spike, said mounting spike extending upwardly from said planar upper surface of said bag tray;

said bag tray adapted to accommodate a flat, unfolded stack of film bags on said upper surface of said bag tray, said bags having at least one circular mounting aperture disposed adjacent an upper end of said bags;

said bag tray being adapted to slide over said at least two retaining ledges and descend behind said at least two retaining ledges upon insertion into said fixed receiving station; and said at least two retaining ledges extending inwardly from first and second sides of said fixed receiving station, having a central opening to provide access to a lower end of said bags and limiting forward movement of said bag tray within said fixed receiving station.

2. The undercounter dispenser, as described in claim 1, further comprising a rear panel, said rear panel being attached to a distal end of said horizontal bottom support platform and limiting aft movement of said bag tray within said fixed receiving station.

3. The undercounter dispenser, as described in claim 1, further comprising a top panel, said top panel connecting said at least two suspension elements.

4. The undercounter dispenser, as described in claim 1, wherein said at least one mounting spike is mounted to at least two alternative positions on said bag tray.

5. The undercounter dispenser, as described in claim 4, wherein said at least one mounting spike is mounted to a sub platform, said sub platform being mounted to at least two alternative positions on said bag tray.

6. The undercounter dispenser, as described in claim 4, wherein said bag tray includes a planar mounting plate, said plate including at least one transverse slot, said slot being sized and shaped to provide adjustable mounting for said at least one mounting spike.

7. The undercounter dispenser, as described in claim 1, wherein said stationary non-movable plate-like attachment features comprise a series of mounting openings incorporated in upper portions of said at least two suspension elements.

8. The undercounter dispenser, as described in claim 1, wherein said stationary non-movable plate-like attachment features comprise a series of mounting openings incorporated in upper portions of proximal and distal ends of said fixed receiving station.

9. The undercounter dispenser, as described in claim 1, further comprising:

a stack of film bags, said bags having a front wall, a back wall, said walls having first and second side edges and a bottom edge;

said front and back walls being joined at said first and second side edges and said bottom edges;

at least one of said front and back walls having at least one mounting aperture adjacent an upper end of said bag.

10. The undercounter dispenser, as described in claim 9, wherein said at least one mounting aperture is frangible.

11. The undercounter dispenser, as described in claim 9, wherein said at least one mounting aperture is disposed in an upper portion of said bag, said upper portion being frangibly attached to said bag.

12. The undercounter dispenser, as described in claim 9, wherein said at least one mounting aperture is disposed in a header strip, said header strip being removably attached to said upper end of said bag.

13. The undercounter dispenser, as described in claim 9, wherein said stack of film bags is enclosed in a flexible pouch, said pouch having at least hole aligned with said at least one mounting aperture.

* * * * *